United States Patent [19]

Swathirajan et al.

[11] Patent Number: 4,758,479

[45] Date of Patent: Jul. 19, 1988

[54] CORROSION RESISTANT NICKEL-ZINC-PHOSPHORUS COATING AND METHOD OF ELECTROPLATING SAID COATING

[75] Inventors: Sundararajan Swathirajan, Troy; Youssef M. Mikhail, Sterling Heights, both of Mich.

[73] Assignee: General Motors Corporation, Detroit, Mich.

[21] Appl. No.: 31,765

[22] Filed: Mar. 30, 1987

[51] Int. Cl.[4] ..... C25D 3/56

[52] U.S. Cl. ..... 428/659; 204/44.7; 420/441; 428/658; 428/679; 428/680

[58] Field of Search ..... 420/441; 204/44.7; 428/658, 659, 679, 680

[56] References Cited

U.S. PATENT DOCUMENTS 4,629,659 12/1986 Kyono et al. ..... 428/659
4,640,872 2/1987 Irie et al. ..... 428/659

FOREIGN PATENT DOCUMENTS 211590 11/1984 Japan ..... 428/659

OTHER PUBLICATIONS

S. Swathirajan, GMR Tech. Information, Abstract No. 209, Jan. 13, 1988.

"Zn-Ni Alloy Plating at High Current Densities", AES Fourth Continuous Strip Plating Symposium, May 1984.

Chem. Abstracts, 139839y, Issue 8, 1985.

S. Swathirajan, "Potentiodynamic & Galvanostatic Stripping Methods for Characterization of Alloy Electrodeposition Process and Product", reprint, J. Electrochem. Soc., vol. 133, No. 4, Apr. 1986.

*Primary Examiner*—G. L. Kaplan
*Attorney, Agent, or Firm*—Lawrence B. Plant

[57] ABSTRACT

Corrosion resistant electrodeposit comprising a solid solution of phosphorus and nickel supersaturated with zinc. The electrodeposit is formed from an electrolyte containing nickel chloride, zinc chloride and sodium hypophosphite having a nickel ion to zinc ion molar ratio between about 7 and about 12 and deposited at current densities greater than about 0.6 A/cm$^2$.

5 Claims, 2 Drawing Sheets

Figure 1:
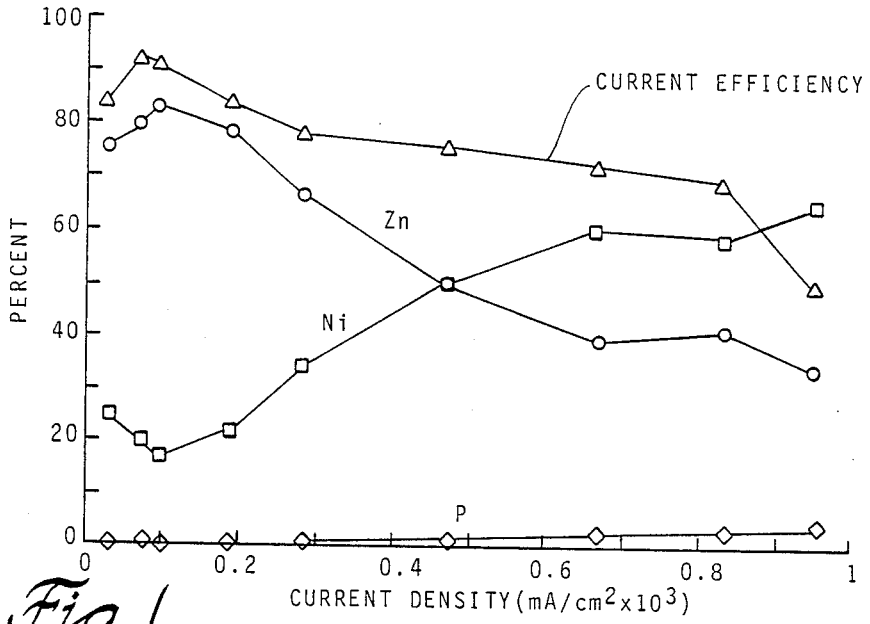
Figure 2:
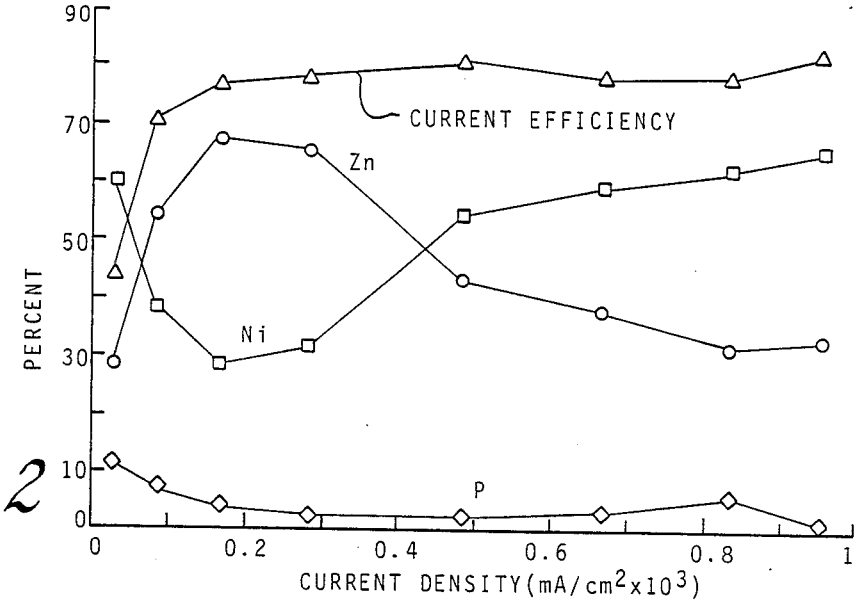
Figure 3:
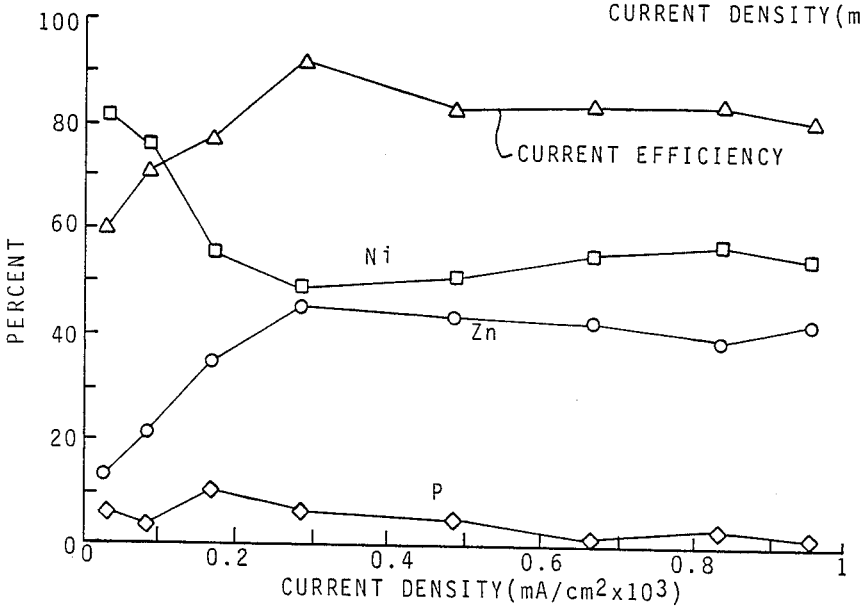

CORROSION RESISTANT NICKEL-ZINC-PHOSPHORUS COATING AND METHOD OF ELECTROPLATING SAID COATING

This invention relates to corrosion resistant metal coatings and a method of electrodepositing the same.

BACKGROUND OF THE INVENTION

Corrosion resistant metal topcoats (i.e., the outermost coating) have been applied to a variety of substrates for many years. A particularly effective such topcoat comprises electrolessly deposited nickel containing about 3% phosphorus (hereafter Ni-P alloy). Such Ni-P alloy topcoats have demonstrated corrosion resistance superior to that of pure nickel and are used to provide cosmetic protection for a variety of products including appliance and interior automobile components. Ni-P coatings, however, are expensive, owing to their high nickel content, and are ineffective topcoats for iron or steel destined for use in environments where galvanic corrosion is prevalent and disruption of the integrity/-continuity of the topcoat is possible. In this latter regard, Ni-P coatings are galvanically more noble than the underlying iron/steel which results in accelerated localized electrochemical consumption of the underlying steel/iron substrate at sites where any breaks/discontinuities occur in the topcoat. Such localized consumption ultimately results in perforation of the substrate at the corrosion site.

Automobile exterior body parts (e.g., fenders, door panels and the like) are among the most difficult parts to protect from corrosion because of the environment in which they must survive and their susceptibility to surface damage tending to create corrosion sites. Steel used for such applications is commonly electrogalvanized (i.e., cathodized @ current densities of about 0.25 $A/cm^2$ to about 1.0 $A/cm^2$) in strip plating reactors wherein substantially continuous lengths of steel strip are advanced rapidly through the electrogalvanizing bath (i.e., electrolyte) in such a manner as to maintain high zrnc ion-concentrations at the surface of the strip and prevent the formation of a thick zinc-ion-depleted diffusion layer thereat during plating. Turbulent or high speed laminar flow are adequate for this purpose and will vary from one reactor to the next. Steel electrogalvanized with binary zinc-nickel alloys has received considerable attention from the steel industry for automobile body applications. Such binary zinc-nickel electrogalvanizing alloys generally contain about 10% to 20% Ni and are a mixture of the $\eta$ (eta) and $\gamma$ (gamma) phases of the alloy. While such binary zinc-nickel electrogalvanizing alloys are not as corrosion resistant as the Ni-P alloys, they are electrochemically less noble than the underlying iron/steel substrate and therefore sacrificially protect the substrate from perforation corrosion wherever the substrate might be exposed. Such nickel-containing zinc electrogalvanizing alloys, however, are not as corrosion resistant as Ni-P alloys and eventually undergo a phase transition during the corrosion/dissolution process which transforms their initially less noble, sacrificial character into one that is more noble than the underlying steel. This nobility reversal occurs when the zinc content falls in the range of about 65–35% by weight zinc at which time the now more noble coating contributes to accelerated localized corrosion at the site of any breaks or disruption therein.

It would be desirable to obtain a protective topcoat: which has a lower nickel content than Ni-P alloy; which has a corrosion-resistance approaching that of Ni-P alloy; and which is easy to apply to the surface of a substrate.

It is an object of the present invention to provide a unique, corrosion resistant Zn-rich, nickel electrodeposit for the improved corrosion protection of underlying substrates. It is another object of the present invention to provide a unique, multi-layer coating system for the corrosion protection of iron or steel including a topcoat of such unique electrodeposit atop a sacrificial zinc layer intermediate the substrate and the topcoat and a Ni-rich, zinc-based alloy buffer layer intermediate the aforesaid sacrificial layer topcoat. It is a still further object of the present invention to provide a current efficient method for forming a continuous layer of the aforesaid corrosion resistant Zn-rich, nickel electrodeposit. These and other objects and advantages of the present invention will become more readily apparent from the detailed description thereof which follows.

BRIEF DESCRIPTION OF THE INVENTION

The invention comprehends a corrosion-resistant, topcoat comprising a substantially amorphous electrodeposit consisting essentially of a solid solution (i.e., at room temperature) of nickel, zinc and phosphorus wherein the zinc constitutes at least 34% to about 43% by weight, the phosphorus constitutes about 1% to about 5% (preferably 2%–4%) by weight and the balance is essentially nickel. The term "substantially amorphous", as used herein, means a microstructure which displays no visible grain structure when viewed at 5000 magnification by a scanning electron microscope. The topcoat of the present invention (hereafter referred to as Zn-rich, Ni-P alloy) is supersaturated with respect to zinc in that it contains more zinc in solid solution with nickel than the equilibrium zinc content shown in phase diagrams reported in the literature. Zn-rich, Ni-P alloys in accordance with the present invention have demonstrated a corrosion resistance (i.e., low corrosion rate) which: is greater than the Ni-rich, zinc alloy coatings used heretofore; is greater than binary nickel-zinc alloys having higher nickel contents; and approaches that of the Ni-P alloy coatings.

The substantially amorphous Zn-rich, Ni-P alloy coating of the present invention may be used alone (i.e., as a single layer) or in combination with a sacrificial zinc-based alloy subcoating(s) intermediate the substrate and topcoat. In this latter regard, the Zn-rich, Ni-P coating of the present invention is electrochemically nobler than an iron or steel substrate and accordingly, when used thereon, will preferably be used over a relatively thick (i.e., Ca. 10 micrometers) sacrificial coating of zinc which protects the underlying iron/steel from perforation corrosion. The sacrificial coating will comprise sufficient zinc that its electrochemical nobility will not undergo a reversal (i.e., with respect to the underlying iron/steel) during the corrosion dissolution process. For all practical purposes essentially pure zinc is the easiest and most effective material for this purpose and may conveniently be electrodeposited from conventional zinc plating baths. Alternately, zinc alloys such as the $\eta$ phases of the zinc-iron, zinc-nickel and zinc-cobalt alloys are also seen to be useful for this purpose as the Fe, Ni and Co content thereof is not high enough to result in a nobility reversal during the normal useful life of the part sought to be protected. Unfortunately, it has been found that the Zn-rich, Ni-P alloys of the present invention will not electroplate directly onto nickel-free or low-nickel content sacrificial zinc layers. Accordingly and in accordance with another aspect of the invention, the sacrificial coating of pure zinc or low alloy zinc will itself be coated with a thinner (i.e., Ca. 3 micrometers) buffer layer of a high Ni-content zinc alloy containing about 19% to about 25% by weight nickel before the topcoat (Ca. 1–3 micrometers thick) of the present invention is deposited. The high Ni-content zinc alloy buffer layer between the sacrificial zinc layer and the Zn-rich, Ni-P topcoat provides numerous nickel sites for the nucleation of nickel during plating and the formation of a continuous adherent layer of topcoat onto the sacrificial layer. The buffer layer will preferably contain up to about 1% phosphorus to refine the grain structure for even better reception of the topcoat. The buffer layer itself deposits readily on the sacrificial zinc layer since that deposit is controlled by the nucleation of zinc rather than nickel.

The supersaturated Zn-rich, Ni-P alloy topcoat of the present invention contains about 2% to about 5% phosphorus. The phosphorus results in the formation of a smooth, continuous electrodeposit and probably accounts for the substantially amorphous character of the deposit. In this regard, without the phosphorus present, only powdery, poorly adherent electrodeposits were obtainable—possibly due to the large overvoltage otherwise required for the nucleation of nickel on zinc. The excessive overvoltage contributes to hydrogen evolution, poor current efficiency, poor deposit morphology and lack of adhesion. On the other hand, the co-deposition of phosphorus along with the nickel and zinc so modifies the nickel-zinc phases as to permit the formation of smooth, continuous coatings at current efficiencies of about 80%. Advantageously, the phosphorus content also promises to promote improved paintability of parts coated with the topcoat of the present invention.

Topcoats in accordance with the present invention are obtainable only under a unique set of electroplating conditions. In this regard, it has been found that substantially continuous, adherent deposits of amorphous Ni-P alloys supersaturated with zinc could only be obtained by plating at high current densities [i.e., exceeding about 0.6 ampere per square centimeter ($A/cm^2$)] in acidic, hypophosphite-containing, chloride-based electrolytes having high (i.e., about 7 to about 12) nickel-to-zinc ion ratios and operated at temperatures greater than about 45° C. At lower current densities and Ni/Zn ratios, zinc supersaturation is not obtained. At lower temperatures, only zinc-based alloys (i.e., greater than 50% Zn) are obtained. Under a particularly effective set of conditions, substrates are electrogalvanized at current densities greater than 0.6 $A/cm^2$ in an electrogalvanizing bath comprising 0.9M nickel chloride, 0.09M zinc chloride (i.e., molar ratio of 10), 20 g/l sodium hypophosphite, 0.4M ammonium chloride to complex the zinc and nickel and keep them in solution, and 0.1M sodium citrate to buffer the solution and maintain pH thereof at about 4.7. Electrogalvanizing under these conditions has yielded the amorphous, zinc-rich, Ni-P alloys of the present invention over a temperature range of 45° C. to 80° C.

Figure 4:
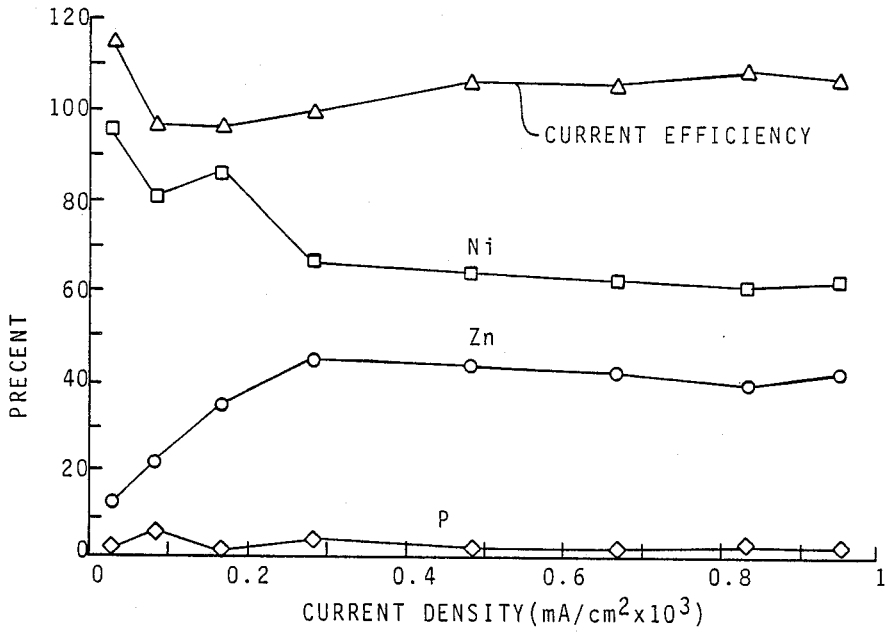
Figure 5:
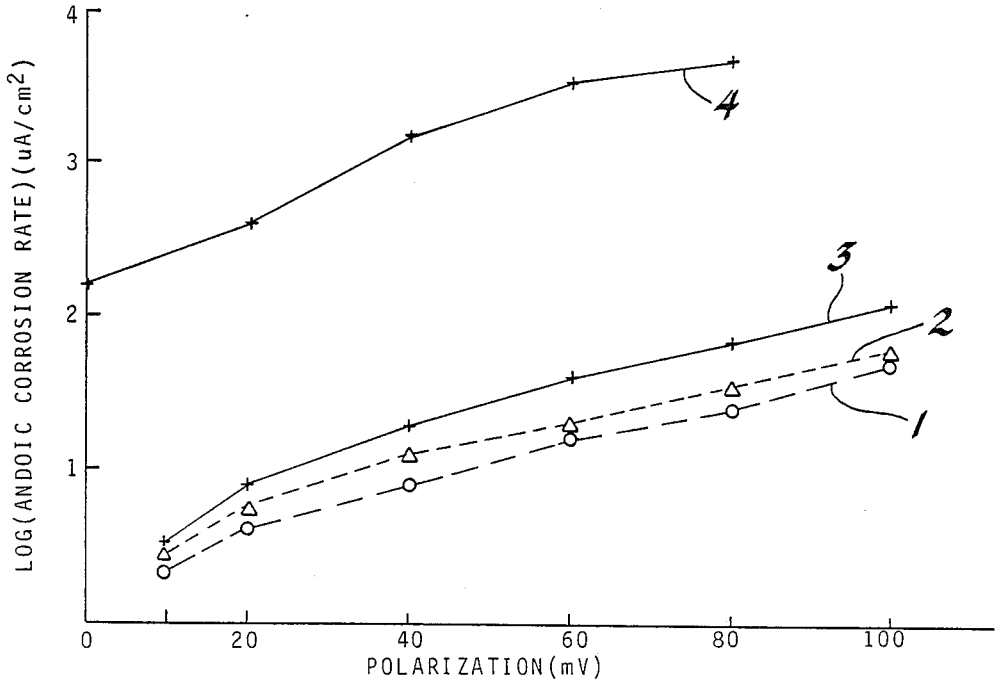

The invention will better be understood when considered in the light of the following examples and tests which are described hereafter in conjunction with the several Figures in which:

FIGS. 1–4 are curves showing the alloy composition and current efficiency for a variety of Ni-Zn-P electrodeposits prepared at different temperatures over a range of plating current densities; and FIG. 5 shows linear polarization curves (i.e., corrosion resistance) for several alloys.

EXAMPLES/TESTS

Electrodeposition experiments were carried out using a power supply capable of delivering up to 1 $A/cm^2$ onto a cylindrical (i.e., 1.9 cm. diameter) steel cathode support having a geometric area of 6.0 $cm^2$. The cathode was rotated at 2000 rpm to provide sufficient electrolyte turbulence near the surface of the cathode and to enhance the supply of zinc ions to the diffusion layer of electrolyte at the surface. The counter-electrode was a concentric platinum mesh electrode having an inner diameter of 7.5 cm. and a height of 2.5 cm. Cathode substrates comprised either steel or copper foil (i.e., 2 mil) wrapped around and secured to the outer surface of the cylindrical support. The mass of the coating (i.e., required for current efficiency measurements) was determined by weighing the wrapped cylinder before and after electrodeposition. The substrate was subjected to a pre-treatment involving mechanical polishing with various grades of polishing paper, degreasing using 1, 1, 1-trichloroethane and chemical etching with 50% nitric acid. Deposition current densities were varied between 0.028 $A/cm^2$ and 0.95 $A/cm^2$. Electrolyte temperature was varied between 45° C. and 80° C.

In one set of tests, the plating solution was prepared using Nanopure conductivity water and reagent grade chemicals and comprised 0.9M nickel chloride, 0.09M zinc chloride, 0.4M ammonium chloride, 0.1M sodium citrate and 20.0 g/l sodium hypophosphite. The nickel and zinc chlorides are the source of the nickel and zinc (i.e., in a ratio of 10 to 1) and provide excellent solution conductivity. The ammonium ions complex the zinc species so as to prevent precipitation of zinc hydroxide which otherwise could interfere with the deposition process. The citrate serves as a buffer to maintain solution pH (i.e., 4.7) during deposition. The hypophosphite serves as the source of phosphorus. Samples were prepared at temperatures of 45° C., 60° C., 70° C. and 80° C. and current densities of 0.028, 0.083, 0.166, 0.283, 0.483, 0.666, 0.833 and 0.950 $A/cm^2$.

The electrodeposited coatings were characterized by scanning electron microscopy (SEM) with energy dispersive X-ray analysis (EDX) and Auger depth profile analysis. The Auger composition was obtained with a 5 kV, 2 microamp electron beam, rastered over an analysis area of 0.5 $mm^2$. Depth profiling was carried out by ion etching with a 3 kV $Ar^+$ beam rastered over a 15 $mm^2$ area. The sputter rate was calibrated as 6.7 nm/min using a $Ta_2O_5/Ta$ standard.

The instantaneous open-circuit corrosion rates of the nickel-zinc-phosphorus coatings were determined using the polarization resistance technique by exposing a circular portion (i.e., 0.36 $cm^2$ area) of each sample to a 5% sodium chloride electrolyte in a three-electrode cell containing a saturated calomel reference and a carbon rod counter-electrode. The working electrode was polarized potentiodynamically using a potentiostat controlled by a computer-based data acquisition and control system.

The composition of the alloy topcoat plated at each temperature and current density was determined by EDX analysis. The coating compositions obtained at various deposition current densities and temperatures (i.e., 45° C., 60° C., 70° C. and 80° C., respectively) are plotted in FIGS. 1–4. However, only those produced at current densities above about 0.6 amps/cm$^2$ were of the amorphous, supersaturated type of the present invention. In general, it was observed that at 45° C. four types of Ni-Zn-P coatings could be obtained by simply varying the current density. At current densities below about 0.6 A/cm$^2$ granular coatings were produced containing 49% or more zinc. Above about 0.6 A/cm$^2$, on the other hand, the amorphous, supersaturated coatings of the present invention were formed. At 80° C. high nickel content coatings (i.e., >80% Ni) were obtained at current densities below about 0.028 A/cm$^2$. Nickel alloys supersaturated with zinc and displaying a high degree of grain coalescence were obtained above about 0.028 A/cm$^2$ but the amorphousness characteristic of the present invention was not obtained until the current density exceeded 0.6 A/cm$^2$.

The determination of the true current efficiency of the electrodeposition process was complicated by the parallel occurrence of the electroless deposition of nickel. Though this is a desirable side-reaction during electrodeposition, it does complicate the current efficiency calculations. Hence, the current efficiency shown in FIGS. 1–4 is actually an apparent efficiency which includes in the calculations the electrolessly deposited metal as well as the electrodeposited metal. FIG. 4, for example, shows that at 80° C., the current efficiencies are above 100% at most current densities which is due to an appreciable contribution from the electroless deposition process ongoing at that temperature. At lower temperatures, the current efficiency curves shown in FIGS. 1–3 follow the same trend as the zinc composition curves, thus demonstrating the inhibiting influence of zinc on the parallel process of hydrogen evolution and probably oxygen reduction. As shown in FIGS. 1–4, one could expect to produce electrodeposits according to the present invention at apparent current efficiencies of about 80% or better.

The microstructure of the electrodeposited coatings was examined using SEM analysis. The SEM examination of the alloy coatings essentially revealed four morphology types, three of which were crystalline or granular in nature and one of which (i.e., the present invention) was substantially amorphous. In general, it was observed: that the deposit microstructure depended more on the deposition current density than on the temperature or composition of the deposit; and that the amorphousness characteristic of the present invention was only obtained at current densities above about 0.6 A/cm$^2$. At lower current densities, the alloys displayed large substantially uniform grains. The morphology exhibited at low current densities (less than 0.083 A/cm$^2$) and temperatures less than 60° C. was characterized by small grains of non-uniform size. The grains appeared non-homogeneous with sub-grain boundaries apparently caused by dislocations or twinning. As the current density rose the grains showed high degrees of coalescence and microcracks developed in the deposits. Finally at current densities in the range above 0.6 the grain structure could no longer be observed at magnifications up to 5000 ×. Some microcracking was also observed.

The composition profile along the depth of the deposit was studied by Auger analysis. It was observed that the Zn-Ni-P coatings of the present invention displayed a surface skin enriched (i.e., compared to the remainder of coating) in nickel and substantially depleted in zinc. It is believed that this Zn-depleted surface skin results in the formation of a passive nickel oxide film reinforced with phosphorus which film probably accounts for at least some of the excellent corrosion resistance observed.

The corrosion behavior of the sample coatings was evaluated using the so-called linear polarization or polarization resistance technique (in 5% NaCl, pH 5.0) which is based on the current-potential behavior of a corroding electrode due to small perturbations (±10 mV) from its corrosion potential. Such technique is discussed in M. Stern and A. L. Geary, *J. Electrochem. Soc.*, 104.56 (1957) and in K. B. Oldham and F. M. Mansfeld, *Corrosion*, 27.434 (1971). While this method provides only approximate estimates of the corrosion rates (i.e., due to uncertainties in the values of the transfer coefficients and the presence of passive films on the electrodes at open-circuit) it does provide a method for comparing the abilities of different coatings to passivate after external polarization and hence their relative ability to resist corrosion. The results of these tests are shown in FIG. 5 which shows that the corrosion rate of the coating of the present invention (i.e., curve 2): was lower than that of conventional electrogalvanized coatings (i.e., curve 4) and coatings having a higher nickel content (i.e., curve 3); and was almost as good as that of Ni-P alloys (i.e., curve 1).

While the linear polarization studies show that the supersaturated amorphous topcoat of the present invention has excellent corrosion resistant properties it is nonetheless electrochemically nobler than an underlying iron or steel substrate. Accordingly, when used with iron or steel substrates which are destined for service/use in environments where the integrity of the topcoat might be disrupted (i.e., cracked, chipped, or otherwise damaged), a sacrificial zinc-based undercoat should be used between the topcoat and the substrate. As indicated above, such an undercoat will preferably consist essentially of zinc—meaning that the zinc content will be sufficient to prevent reversal of the electrochemical nobility of the undercoat with respect to the substrate over the normal useful life of the part being coated. For all practical purposes, substantially pure zinc is the undercoating of choice since it is inexpensive and easy to plate from conventional zinc plating baths. The zinc-based sacrificial undercoat will have sufficient thickness to survive the life of the part being coated and, in the case of sheet steel used for automobile body panels, will be about 10 micrometers thick. It has been found, however, that the topcoat of the present invention does not readily plate directly onto such zinc-based sacrificial undercoats owing to the inability of the nickel to properly nucleate on the zinc surface. Accordingly and in accordance with another aspect of the present invention, an intermediate high Ni-content zinc alloy buffer layer is deposited atop the undercoat to receive and promote deposition of the topcoat. The buffer layer need only be about 3 micrometers thick and have a sufficiently high Ni content to effect nucleation of the nickel in the topcoat during electrogalvanization. Gamma phase nickel-zinc alloys having a nickel content of about 18% to about 25% are preferred and can readily be obtained by electro-plating with conventional Ni-Zn alloy plating baths. Preferably sodium hypophosphite will be added to the bath used to plate the buffer layer so as to codeposit a small amount (i.e., less than 1%) of phosphorus along with the nickel and the zinc to refine the grain structure of the buffer layer and thereby promote even better nucleation of the nickel in the topcoat. A particularly convenient way to plate both the buffer layer and the topcoat involves the use of the same bath and strip plater but plating the buffer layer at a low current density (e.g., Ca. 0.3 $A/cm^2$) and then increasing the current higher current density above 0.6 $A/cm^2$ to deposit the topcoat after a sufficient thickness of buffer layer has deposited.

While the invention has been described solely in terms of specific embodiments and examples thereof it is not intended to be limited thereto but rather only to the extent set forth hereafter in the claims which follow.

The embodiments of the invention in which an exclusive property or privilege is claimed are defined as follows:

1. An article of manufacture comprising a substrate having a corrosion-resistant, substantially amorphous electrodeposited coating thereon consisting essentially of a solid solution of nickel, zinc and phosphorus wherein the zinc constitutes about 34% to about 43% by weight, the phosphorus about 2% to about 5% by weight and balance is essentially nickel.

2. Corrosion-resistant steel comprising: a steel substrate; a galvanically sacrificial electrodeposited coating adhering to said substrate, said sacrificial coating consisting essentially of zinc; an electrodeposited Zn-based alloy buffer coating adhering to said sacrificial coating, said buffer coating comprising sufficient nickel to nucleate nickel deposition during the electrodeposition of a subsequently applied Ni-based alloy topcoat; and a continuous, Ni-based electrodeposited alloy topcoat adhering to said buffer coating, said topcoat consisting essentially of a substantially amorphous, solid solution of nickel, zinc and phosphorus wherein the zinc constitutes about 34% to about 43% by weight, the phosphorus about 2% to about 5% by weight and the balance essentially nickel.

3. Steel as defined in claim 2 wherein said buffer coating contains about 18% to about 25% nickel and a small but effective amount of phosphorus for grain refinement of said Zn-based buffer coating.

4. An electrogalvanization method for depositing a substantially amorphous solid solution of phosphorus and nickel having about 34% to about 43% zinc dissolved therein onto a substrate said method comprising the steps of:

contacting said substrate with a turbulent, acidic electrolyte comprising (a) nickel chloride and zinc chloride in a molar ratio of about 7 to about 12, (b) sufficient sodium hypophosphite to provide about 2% to about 5% by weight phosphorus in the deposit, (c) sufficient ammonium chloride to complex the nickel and zinc and keep it in solution and (d) a buffer to stabilize the acidity of the electrolyte; and cathodizing said substrate in said electrolyte at a current density of at least about 0.6 $A/cm^2$.

5. The method as described in claim 4 wherein each liter of said electrolyte comprises about 0.9 moles of nickel chloride, about 0.09 moles of zinc chloride, about 0.4 moles of ammonium chloride, about 0.1 moles of sodium citrate and about 20 g/l of sodium hypophosphite.

* * * * *